US008088051B2

(12) United States Patent
Hung

(10) Patent No.: US 8,088,051 B2
(45) Date of Patent: Jan. 3, 2012

(54) ADJUSTABLE SPHINCTER EXERCISER

(76) Inventor: Chien-Hsiung Hung, Taipei (TW)

( * ) Notice: Subject to any disclaimer, the term of this patent is extended or adjusted under 35 U.S.C. 154(b) by 0 days.

(21) Appl. No.: 12/662,539

(22) Filed: Apr. 22, 2010

(65) Prior Publication Data

US 2011/0263396 A1 Oct. 27, 2011

(51) Int. Cl.
*A63B 71/00* (2006.01)
*A63B 15/02* (2006.01)
*A61H 1/00* (2006.01)

(52) U.S. Cl. ..... 482/139; 482/1; 601/70

(58) Field of Classification Search ..... 482/1, 2, 482/4, 139, 91, 124, 131; 601/70, 71, 72, 601/74, 79–81; 600/591
See application file for complete search history.

(56) References Cited

U.S. PATENT DOCUMENTS 3,528,423 A * 9/1970 Lee ..... 604/329
4,515,167 A * 5/1985 Hochman ..... 600/549
4,873,996 A * 10/1989 Maurer ..... 607/138
4,881,526 A * 11/1989 Johnson et al. ..... 601/15
4,953,563 A * 9/1990 Kaiser et al. ..... 600/591
6,183,402 B1 * 2/2001 Pedersen et al. ..... 482/105
6,183,428 B1 * 2/2001 Kilgore ..... 601/70
6,217,529 B1 * 4/2001 Wax et al. ..... 600/591
6,384,729 B1 * 5/2002 Plotkin ..... 340/573.1
6,905,471 B2 * 6/2005 Leivseth et al. ..... 600/591
7,014,603 B2 * 3/2006 Stein ..... 482/148
7,473,214 B2 * 1/2009 Schuurmans Stekhoven et al. ..... 482/142
2005/0148447 A1 * 7/2005 Nady ..... 482/121
2007/0112284 A1 * 5/2007 Hoffman et al. ..... 600/591
2007/0260210 A1 * 11/2007 Conroy ..... 604/385.01

* cited by examiner

*Primary Examiner* — Allana Lewin

(57) ABSTRACT

An adjustable sphincter exerciser (Kegel exercise) includes a flexible tubular member, at least one sleeve mounted to the tubular member; a body inserted into the tubular member, a conductive device connected to the body and located in the tubular member, the conductive device being activated when the tubular member is compressed, a vibration unit electrically connected to the conductive device, and a power unit providing power to the conductive device and the vibration unit. The at least one sleeve can be replaced and has different hardness, when the user squeezes the at least one sleeve and the tubular member to activate the conductive device and the vibration unit, the user is acknowledged the force that sphincter is exercised. The adjustable sphincter exerciser (Kegel exercise) enhances the muscular strength and the muscular endurance of the sphincter.

6 Claims, 6 Drawing Sheets

ADJUSTABLE SPHINCTER EXERCISER

BACKGROUND OF THE INVENTION (1) Field of the Invention

The present invention relates to an exerciser, and more particularly, to an adjustable sphincter exerciser (Kegel exercise) that adjustably trains the sphincter and the user is acknowledged the progress of the training.

(2) Description of the Prior Art

A conventional exerciser for training the sphincter generally includes a knob device which adjusts the distance between a flexible plate and a metal block. The user controls the sphincter to make the flexible plate and the metal block be in contact with each other so as to activate the vibration device to acknowledge the user. The required force can be adjustable according to specific conditions of individual users. The required force can be set so that the user can exercise the sphincter to approach the pre-set standard. Although the restriction of the sphincter is maintained within a pre-set range, the muscular strength and the muscular endurance can be trained. Therefore, adding sleeves of different hardness to the tubular body of the exerciser can achieve the purpose to exercise the muscular strength and the muscular endurance of the sphincter. The adjustment of the distance between the flexible plate and the metal block cannot be increased unlimited, so that for the users who use the conventional sphincter exerciser, they cannot know the progress of the muscular strength and the muscular endurance.

The present invention intends to provide an adjustable sphincter exerciser (Kegel exercise) which improves the shortcomings of the conventional sphincter exerciser.

SUMMARY OF THE INVENTION

The present invention relates to an adjustable sphincter exerciser (Kegel exercise) that comprises a flexible tubular member and a body is connected to an end of the tubular member. A conductive device is connected to the body and located in the tubular member. The conductive device is activated when the tubular member is compressed. A vibration unit is electrically connected to the conductive device and located in the body. The vibration unit is activated when the conductive device is activated. Both of the vibration unit and the conductive device are powered by a power unit. At least one sleeve is mounted to the tubular member and includes pre-set hardness. The user squeezes the at least one sleeve and the tubular member to activate the conductive device by the sphincter to exercise the sphincter.

The primary object of the present invention is to provide an adjustable sphincter exerciser (Kegel exercise) that conveniently sets the constriction force of the sphincter and the users are acknowledged the progress that the sphincter obtains.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
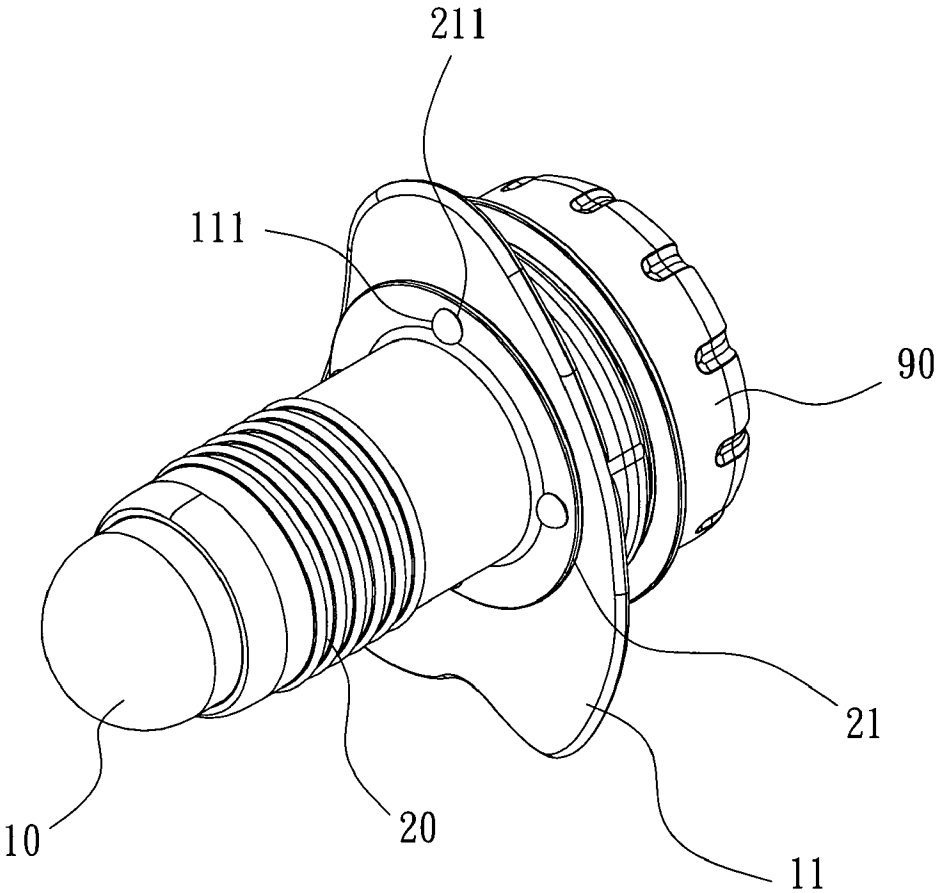
FIG. 1 is a perspective view to show the adjustable sphincter exerciser (Kegel exercise) of the present invention.
Figure 2:
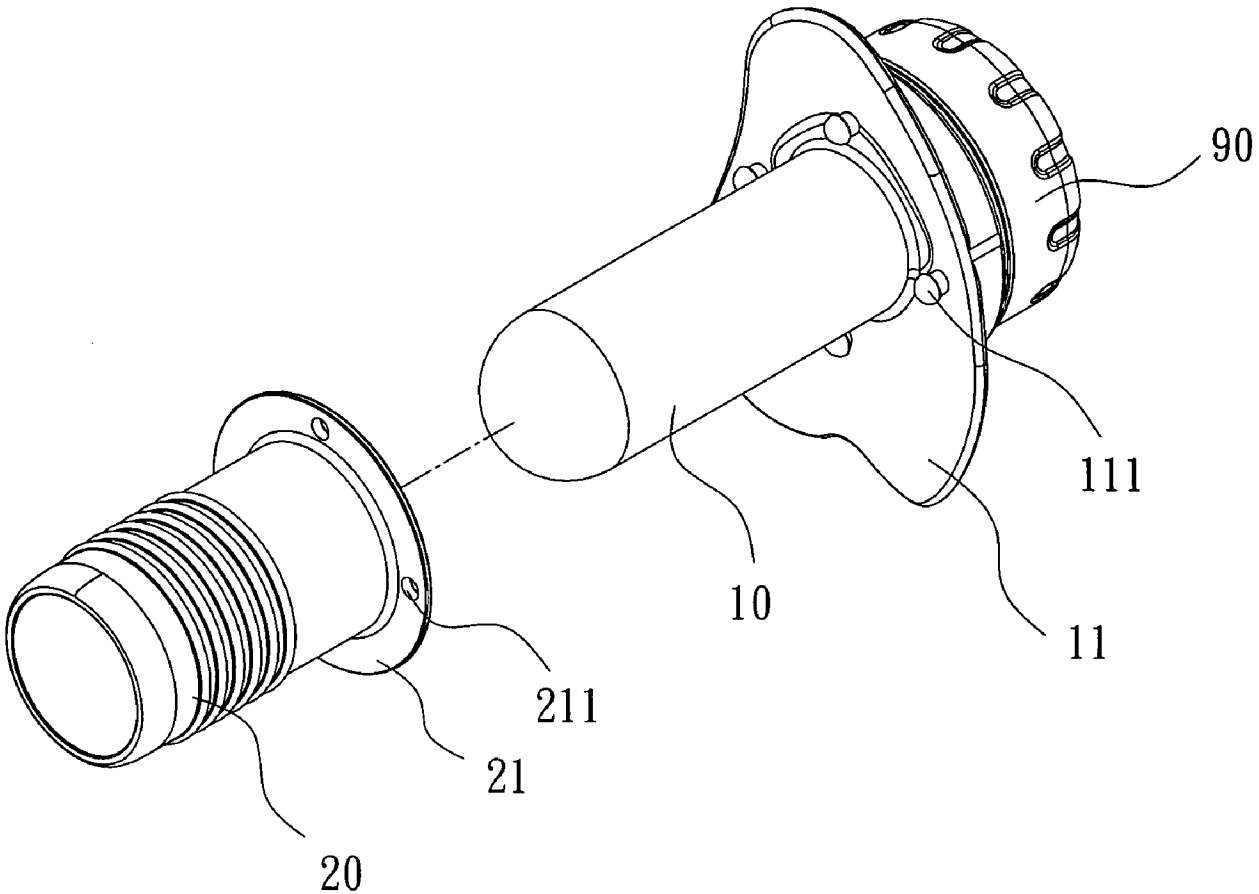
FIG. 2 shows the sleeve and the tubular member of the adjustable sphincter exerciser (Kegel exercise) of the present invention.
Figure 3:
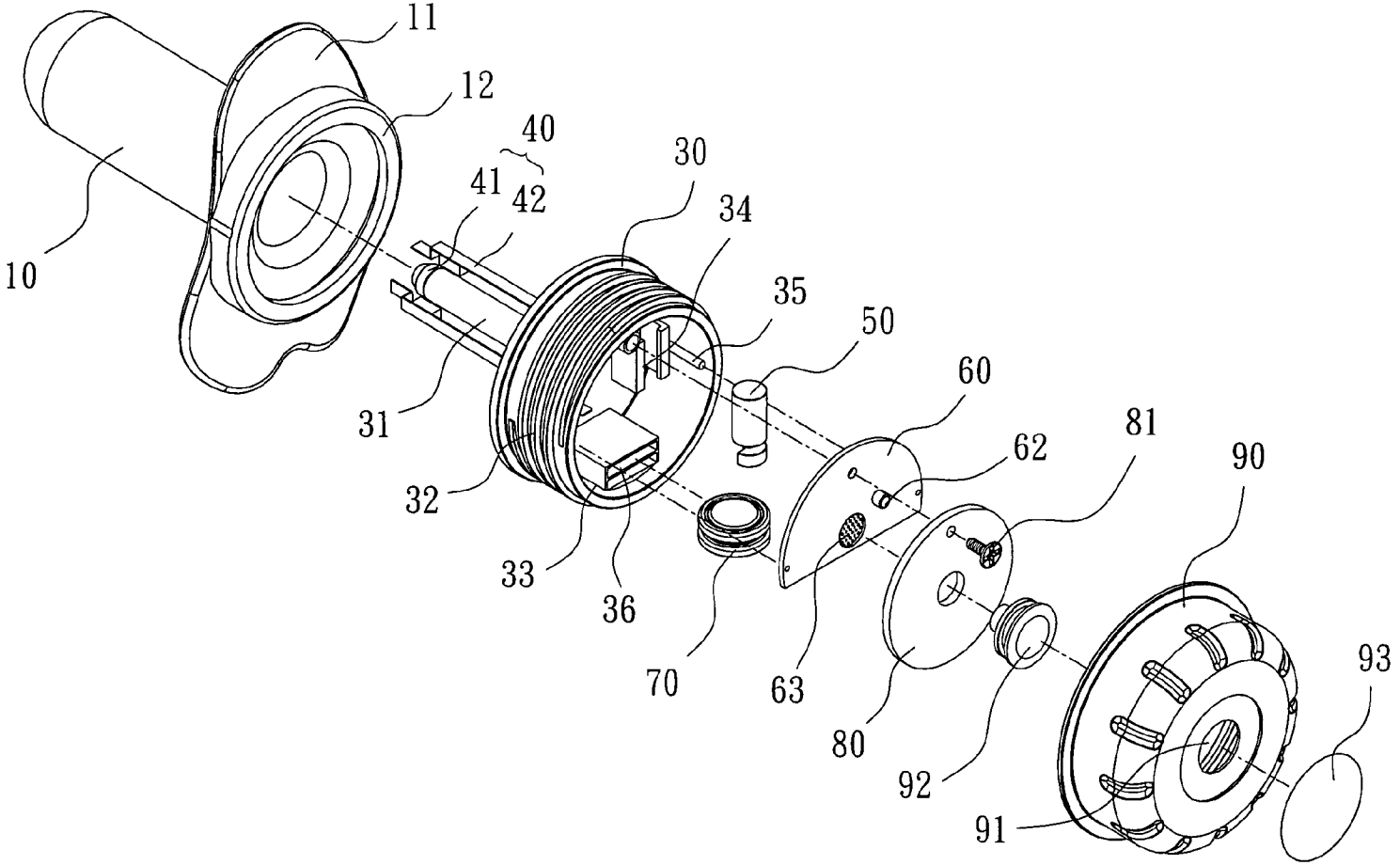
FIG. 3 is an exploded view to show the adjustable sphincter exerciser (Kegel exercise) of the present invention.
Figure 4:
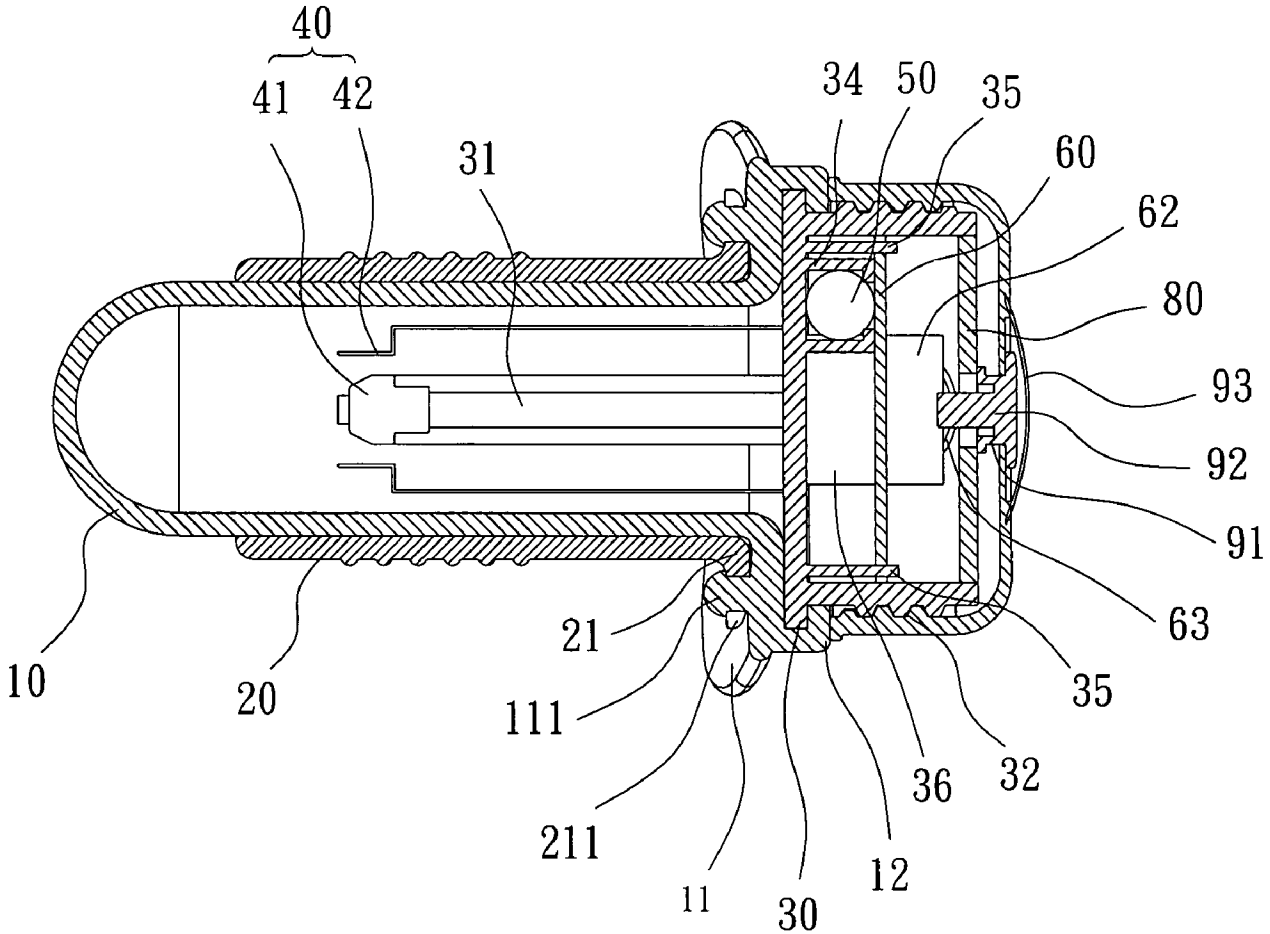
FIG. 4 is a cross sectional view of the adjustable sphincter exerciser (Kegel exercise) of the present invention.

Referring to FIGS. 1 to 4 and 8, the adjustable sphincter exerciser (Kegel exercise) of the present invention comprises a flexible tubular member 10 which has a first flange 11 extending radially outward from the first end thereof. Multiple protrusions 111 extend from a first side of the first flange 11 and toward the second end of the tubular member 10. A neck 12 extends from the second side of the first flange 11.

At least one sleeve 20 is made of resilient material and mounted to the tubular member 10. The sleeve 20 includes a second flange 21 and multiple holes 211 are defined through the second flange 21 such that the protrusions 111 extend through the hole 211 to position the sleeve 20 to the tubular member 10. The sleeve 20 is removably mounted to the tubular member 10 and can be replaced with another one.

A body 30 is connected to the first end of the tubular member 10 by engaging its outer periphery with the inside of the neck 12, and a post 31 extends from the body 30 and is inserted into the tubular member 10. The body 30 further includes a threaded extension 32 and a space 33 is defined in the threaded extension 32. Multiple positioning member 34, rods and reception members 36 are located in the space 33.

A conductive device 40 is located in the tubular member 10 and includes a metal portion 41 and multiple conductive plates 42. The metal portion 41 is connected to the post 31 of the body 30 and the conductive plates 42 are connected to the body 30. Each of the conductive plates 42 includes a bent portion which is located close to the metal portion 41. By the arrangement, when the tubular member 10 is squeezed by the sphincter, the bent portions of the conductive plates 42 contact the metal portion 41 to form a conductive loop.

A vibration unit 50 is electrically connected to the conductive plates 42 of the conductive device 40 which drives the vibration unit 50. The vibration unit 50 is positioned by the positioning members 34 and includes an eccentric motor which generates vibration when the vibration unit 50 is driven.

A circuit board 60 is received in the space 33 of the body 30 and is positioned by the rods 35. The circuit board 60 includes an audio circuit 61 and a speaker 62 which is activated by the audio circuit 61 to generate audio sound which can be any type of sound so as to guide the users to exercise the sphincter. The circuit board 60 includes a switch 63 for activating the audio circuit 61 and the switch 63 can be a multiple steps switch which can be pressed to control the audio sound and other modes.

A power unit 70 is located in the reception members 36 and provides power to the conductive device and the vibration unit 50. The power unit 70 can be batteries.

A separation plate 80 includes a bolt to be fixed to the body 30 and engaged with the space 33 so as to prevent the parts in the space from dropping off.

An end cap 90 is threadedly connected to the threaded extension 32 and covers the space 33. The end cap 90 has an aperture 91 and a button 92 extends through the aperture 91. The button 92 extends through the separation plate 80 so that the users can press the button 92, and the other end of the button 92 can touch the switch 63 when the button 92 is pressed. A flexible plate 93 seals the aperture 91 to protect the button 92.

In a non-use status, the bent portions of the conductive plates 42 are not in contact with the metal portion 41 so that the vibration unit 50 is not activated.

When the sleeve 20 and the tubular member 10 are inserted into the user's vagina and the user uses the sphincter to squeeze the tubular member 10, when the restriction force overcomes the resistance of the sleeve 20, the bent portions of the conductive plates 42 are in contact with the metal portion 41, and the vibration unit 50 is activated to acknowledge the user that a pre-set force is applied to the exerciser by the sphincter.

Figure 5:
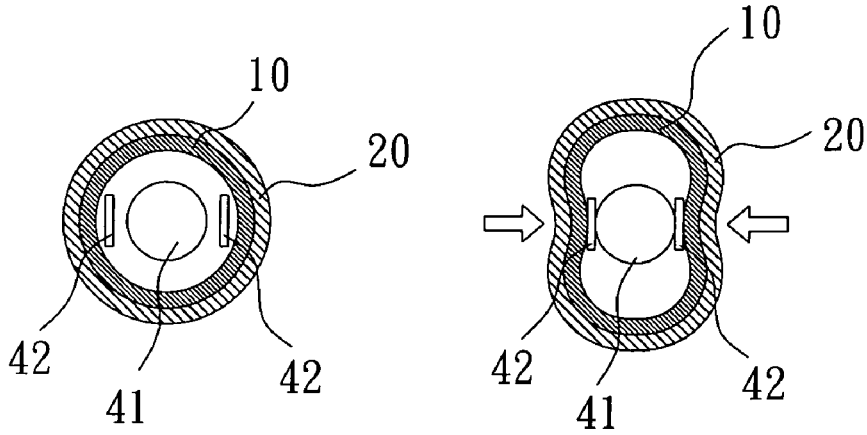
FIGS. 5 to 7 show different forces are required to squeeze the different sleeves on the tubular member of the adjustable sphincter exerciser (Kegel exercise) of the present invention.
Figure 6:
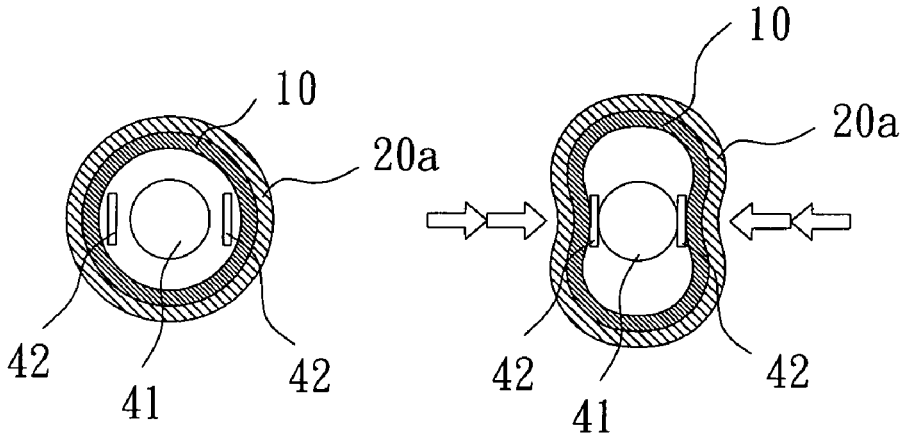
Figure 7:
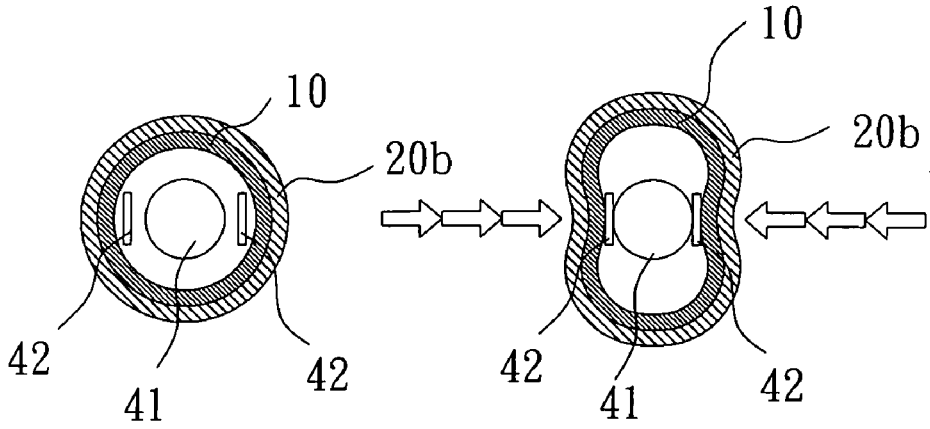
Figure 8:
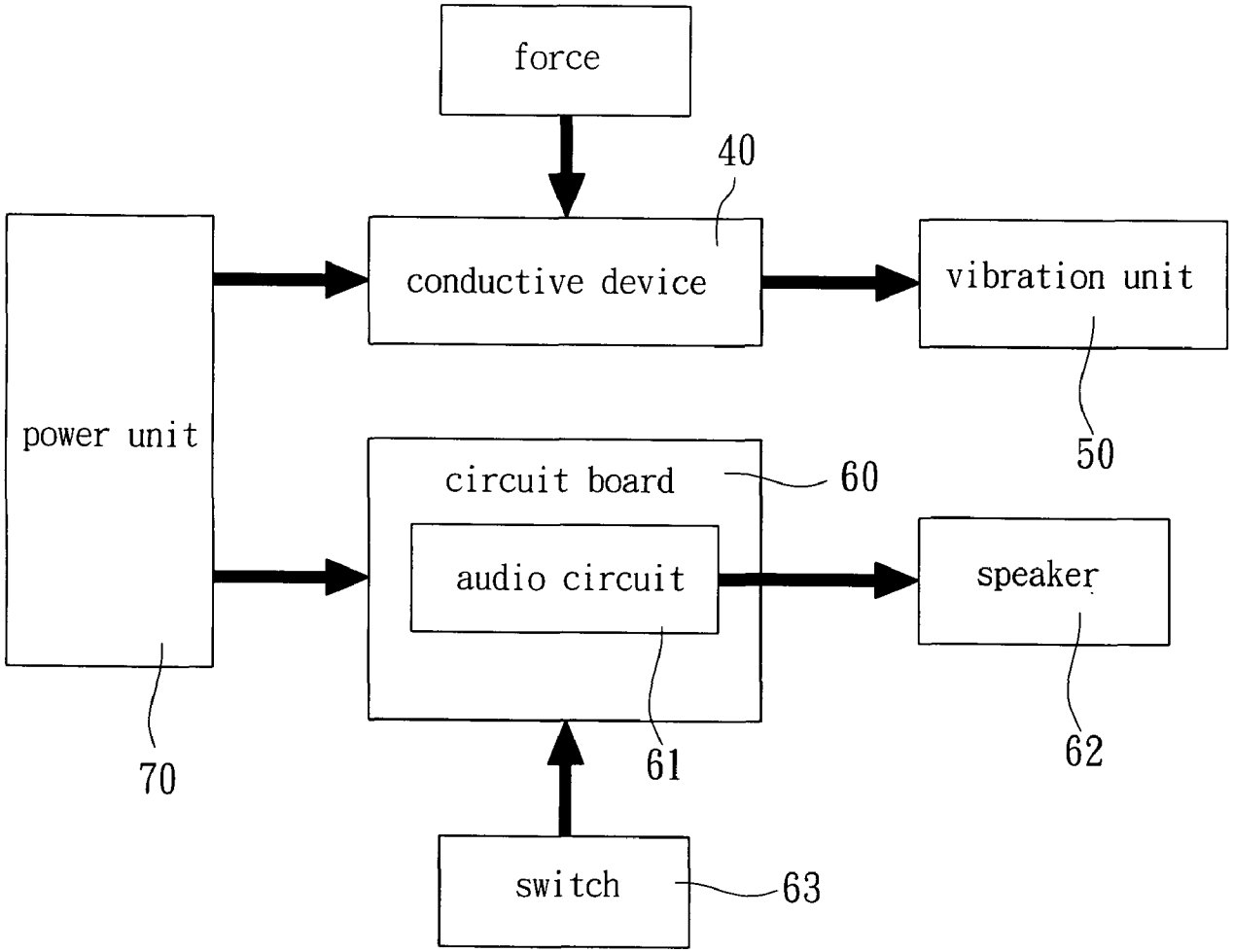
FIG. 8 illustrates the flow chart of the actions of the adjustable sphincter exerciser (Kegel exercise) of the present invention.

As shown in FIGS. 5 to 7, the sleeves 20*a*, 20*b* can be made of different material to have different flexibility, so that different levels of force is required to compress the sleeve 20*a*/20*b* to activate the vibration unit 50 so as to set different levels of standards of the training.

The modes of the circuit board 60 include sound guiding training, self training and unplug training. When the switch 63 is pressed and shift to the mode of sound guiding training, the audio circuit 61 drives the speaker 62 to generate instructions to guide the user to proceed the restriction action of the sphincter.

While we have shown and described the embodiment in accordance with the present invention, it should be clear to those skilled in the art that further embodiments may be made without departing from the scope of the present invention.

What is claimed is:

1. An adjustable sphincter exerciser comprising:

a flexible tubular member;

a plurality of sleeves of different flexibilities adapted to be interchangeably, removably mounted to the tubular member;

a body connected to the tubular member;

a conductive device located in the tubular member and being activated when the tubular member is compressed wherein the conductive device includes a metal portion and at least one conductive plate, the metal portion is connected to a post of the body and the at least one conductive plate is connected to the body, the at least one conductive plate includes a bent portion which is located close to the metal portion such that pressure on the tubular member causes the at least one conductive plate to contact the metal portion to form a conductive loop;

a vibration unit electrically connected to the conductive device which drives the vibration unit, and a power unit providing power to the conductive device and the vibration unit.

2. The adjustable sphincter exerciser as claimed in claim 1, wherein the tubular member including multiple protrusions and the at least one sleeve has holes through which the protrusions extend.

3. The adjustable sphincter exerciser as claimed in claim 1, wherein a circuit board connected to the body and includes an audio circuit and a speaker which is activated by the audio circuit to generate audio sound.

4. The adjustable sphincter exerciser as claimed in claim 3, wherein the circuit board includes a switch for activating the audio circuit.

5. The adjustable sphincter exerciser as claimed in claim 4, wherein the body includes an end cap which has an aperture and a button extends through the aperture, the button is pressed to touch the switch.

6. The adjustable sphincter exerciser as claimed in claim 5, wherein a flexible plate seals the aperture to protect the button.

* * * * *